US010947614B2

(12) United States Patent
Haruyama et al.

(10) Patent No.: US 10,947,614 B2
(45) Date of Patent: Mar. 16, 2021

(54) METHOD FOR PRODUCING METAL CYLINDER, METHOD FOR PRODUCING SUBSTRATE FOR ELECTROPHOTOGRAPHIC PHOTORECEPTOR, METHOD FOR MANUFACTURING ELECTROPHOTOGRAPHIC PHOTORECEPTOR, AND METAL SLUG FOR IMPACT PRESSING

(71) Applicant: FUJI XEROX CO., LTD., Tokyo (JP)

(72) Inventors: Daisuke Haruyama, Kanagawa (JP); Akira Sato, Kanagawa (JP); Hiroshi Tamemasa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 48 days.

(21) Appl. No.: 16/401,867

(22) Filed: May 2, 2019

(65) Prior Publication Data

US 2019/0256959 A1 Aug. 22, 2019

Related U.S. Application Data

(62) Division of application No. 15/226,170, filed on Aug. 2, 2016, now Pat. No. 10,329,652.

(30) Foreign Application Priority Data

Mar. 11, 2016 (JP) ..... 2016-048865

(51) Int. Cl.

| | |
|---|---|
| ***C22F 1/047*** | (2006.01) |
| ***B21C 1/26*** | (2006.01) |
| ***B21C 23/18*** | (2006.01) |
| ***G03G 5/10*** | (2006.01) |

(52) U.S. Cl.
CPC ..... *C22F 1/047* (2013.01); *B21C 1/26* (2013.01); *B21C 23/186* (2013.01); *G03G 5/102* (2013.01)

(58) Field of Classification Search
CPC ..... C22F 1/047; G03G 5/102; G03G 5/00; B21C 1/26; B21C 23/186; B21D 22/02; B21D 37/10
See application file for complete search history.

(56) References Cited

U.S. PATENT DOCUMENTS

2014/0045110 A1 2/2014 Matsuki et al.

FOREIGN PATENT DOCUMENTS

| | | | |
|---|---|---|---|
| JP | 60-149717 | A | 8/1985 |
| JP | 61-44150 | A | 3/1986 |
| JP | 2000-129384 | A | 5/2000 |
| JP | 2008-132503 | A | 6/2008 |
| JP | 2014-38135 | A | 2/2014 |
| JP | 2014-38138 | A | 2/2014 |

OTHER PUBLICATIONS

Communication dated Jan. 7, 2020, from the Japanese Patent Office in Application No. 2016-048865.

*Primary Examiner* — Moshe Wilensky
(74) *Attorney, Agent, or Firm* — Sughrue Mion, PLLC

(57) ABSTRACT

A method for producing a metal cylinder includes preparing a metal slug having a surface adjusted so that the crystal grain diameter at a depth of 10 μm from the surface is smaller than that at a depth of 100 μm from the surface, and the crystal grain diameter at a depth of 10 μm from the surface is 30 μm or more and 120 μm or less; and forming a cylinder by impact pressing of the metal slug having the surface as a bottom.

5 Claims, 5 Drawing Sheets

METHOD FOR PRODUCING METAL CYLINDER, METHOD FOR PRODUCING SUBSTRATE FOR ELECTROPHOTOGRAPHIC PHOTORECEPTOR, METHOD FOR MANUFACTURING ELECTROPHOTOGRAPHIC PHOTORECEPTOR, AND METAL SLUG FOR IMPACT PRESSING

CROSS-REFERENCE TO RELATED APPLICATIONS

This application is a Divisional of U.S. application Ser. No. 15/226,170 filed Aug. 2, 2016, which is based on and claims priority under 35 USC 119 from Japanese Patent Application No. 2016-048865 filed Mar. 11, 2016, the contents of all of which are incorporated herein by reference in their entireties.

BACKGROUND

(i) Technical Field

The present invention relates to a method for producing a metal cylinder, a method for producing a substrate for an electrophotographic photoreceptor, a method for manufacturing an electrophotographic photoreceptor, and a metal slug for impact pressing.

(ii) Related Art

An apparatus which sequentially performs charging, exposure, development, transfer, cleaning, etc. by using an electrophotographic photoreceptor (may be referred to as a "photoreceptor" hereinafter) has been widely known as an electrophotographic image forming apparatus.

Known electrophotographic photoreceptors include a function-separation-type photoreceptor in which a charge generation layer that generates charge by exposure and a charge transport layer that transports charge are laminated on a support having conductivity such as an aluminum support or the like, and a single-layer-type photoreceptor in which the same layer performs both the function of generating charge and the function of transporting charge.

For example, a method of adjusting the thickness, surface roughness, and the like of an aluminum element tube by cutting the peripheral surface thereof is known as a method for producing a cylindrical substrate serving as a conductive support of an electrophotographic photoreceptor.

On the other hand, impact pressing for forming a cylinder by applying impact with a punch to a metal slug placed in a die (female die) is known as a method for mass-producing a thin metal container or the like at low cost.

SUMMARY

According to an aspect of the invention, there is provided a method for producing a metal cylinder including preparing a metal slug having a surface adjusted so that the crystal grain diameter at a depth of 10 μm from the surface is smaller than that at a depth of 100 μm from the surface, and the crystal grain diameter at a depth of 10 μm from the surface is 30 μm or more and 120 μm or less; and forming a cylinder by impact pressing of the metal slug having the surface as a bottom.

BRIEF DESCRIPTION OF THE DRAWINGS

Exemplary embodiments of the present invention will be described in detail based on the following figures, wherein.

DETAILED DESCRIPTION

Figure 1A:
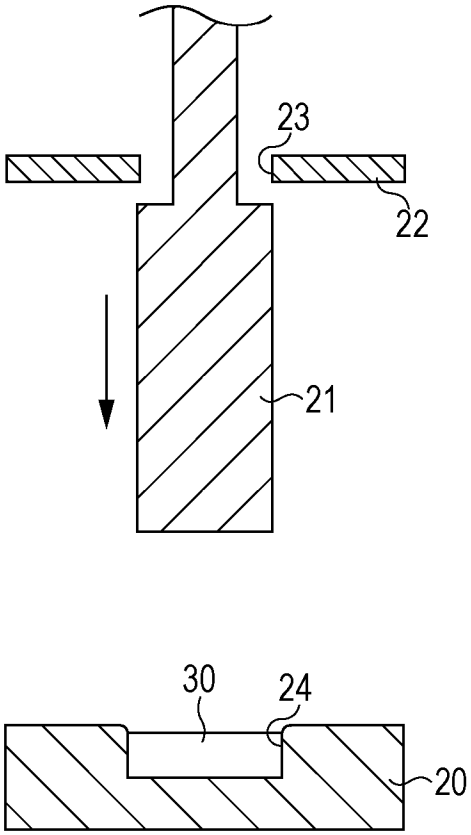
FIGS. 1A to 1C are schematic views showing an example of impact pressing in a method for producing a metal cylinder according to an exemplary embodiment of the invention.

Exemplary embodiments of the present invention are described below with reference to the drawings. In the drawings, elements having the same function are denoted by the same reference numeral, and duplicate description is eliminated.

Method for Producing Metal Cylinder

A method for producing a metal cylinder according to an exemplary embodiment of the invention includes preparing a metal slug having a surface adjusted so that the crystal grain diameter at a depth of 10 μm from the surface is smaller than that at a depth of 100 μm from the surface, and the crystal grain diameter at a depth of 10 μm from the surface is 30 μm or more and 120 μm or less; and forming a cylinder by impact pressing of the metal slug having the surface as a bottom.

In general impact pressing, for example, a metal slug of aluminum or the like (may be referred to as a "slug" hereinafter) is disposed in a circular female die, and a cylinder may be formed along a cylindrical male die by striking with the die under high pressure.

For example, when a cylindrical substrate for an electrophotographic photoreceptor is produced by impact pressing, the electrophotographic photoreceptor is produced by molding a cylindrical aluminum tube by impact pressing, then adjusting the inner and outer diameters, cylindricity, and circularity by ironing, and further forming a photosensitive layer and the like on the outer peripheral surface of the cylinder.

However, when a cylinder is molded by impact pressing, many fine recesses may be produced at specific positions, and there is an individual difference in the number of recesses. When a toner image is formed by an image forming apparatus provided with an electrophotographic photoreceptor manufactured by forming a photosensitive layer and the like on the outer peripheral surface of such a cylinder having many recesses, an output image is influenced by the recesses present on the outer peripheral surface of the cylinder depending on the size of the recesses, and thus dot defects may occur in the image.

When a cylinder is produced by impact pressing, the cause for the occurrence of a recessed portion is unclear but is supposed as follows.

A phenomenon of so-called "surface roughness" which is caused by plastic deformation of a metal occurs during impact pressing. The "surface roughness" represents projections and recesses formed in a surface of a metal, and it is considered that the projections among the projections and recesses of the surface are scraped by a female die to be flattened, while the recesses remain in the metal surface.

On the other hand, the method for producing a metal cylinder according to the exemplary embodiment of the invention may produce a metal cylinder with suppressed occurrence of recessed portions in the outer peripheral surface. The reason for this is considered as follow.

In impact pressing, the bottom of the slug before impact pressing is partially extended to form the peripheral surface of the cylinder. The "surface roughness" described above is considered to occur due to protrusion of crystal grains present at the bottom of the slug during impact pressing, and the larger the crystal grains, the higher the surface roughness.

The method for producing a metal cylinder according to the exemplary embodiment of the invention includes impact pressing the metal slug having the surface (surface containing small crystal grains) as a bottom adjusted so that the crystal grain diameter at a depth of 10 μm from the surface is smaller than that at a depth of 100 μm from the surface, and the crystal grain diameter at a depth of 10 μm from the surface is 30 μm or more and 120 μm or less, thereby suppressing the occurrence of surface roughness. This is considered to be due to the fact that the crystal grains become decreased in size by increasing the surface hardness of the slug by shot peening, and accordingly the surface roughness is suppressed even during impact pressing, thereby suppressing the occurrence of recesses in the outer peripheral surface of the resultant cylinder.

In addition, when the size of crystal grains in the slug surface is excessively decreased by shot peening, the hardness is excessively increased, and thus impact pressing becomes difficult.

The case of production of a cylindrical substrate for an electrophotographic photoreceptor is specifically described as an example of the method for producing a metal cylinder according to the exemplary embodiment of the invention.

For example, when a cylindrical substrate for an electrophotographic photoreceptor is produced by the method for producing a metal cylinder according to the exemplary embodiment of the invention, a slug having a surface adjusted so that the crystal grain diameter at a depth of 10 μm from the surface is smaller than that at a depth of 100 μm from the surface, and the crystal grain diameter at a depth of 10 μm from the surface is 30 μm or more and 120 μm or less is prepared, the metal slug is molded into a cylinder by impact pressing of the metal slug with the surface as a bottom, and the peripheral surface of the cylinder is ironed. Each of the processes is described in detail below.

Preparation

In the preparation, the slug having a surface is prepared, the surface being adjusted so that the crystal grain diameter at a depth of 10 μm from the surface is smaller than that at a depth of 100 μm from the surface, and the crystal grain diameter at a depth of 10 μm from the surface is 30 μm or more and 120 μm or less.

The material, shape, size, etc. of the slug may be selected according to application of the metal cylinder produced.

When the cylindrical substrate constituting an electrophotographic photoreceptor is produced, an aluminum or aluminum alloy-made disk or cylindrical slug is used.

In addition, an elliptic cylindrical or prismatic slug, or the like may be used according to application of the metal cylinder produced.

Examples of an aluminum alloy contained in the slug include aluminum alloys containing aluminum and, for example, Si, Fe, Cu, Mn, Mg, Cr, Zn, Ti, or the like.

The aluminum alloy contained in the slug used for producing the cylindrical substrate of the electrophotographic photoreceptor is a so-called 1000-series alloy.

From the viewpoint of workability, the aluminum content (aluminum purity: weight ratio) in the slug is preferably 90.0% or more, more preferably 93.0% or more, and further preferably 95.0% or more.

A method for forming the slug is not limited and, for example, when the cylindrical or disk-shaped slug is used, examples of the method include a method of cutting a rod-shaped metal material having a circular section perpendicular to a longitudinal direction into a length corresponding to the height (thickness) of the slug, a method of punching a circular shape in a metal plate having a thickness corresponding to the height (thickness) of the slug, and the like.

The slug has a columnar or disk-like shape and has a surface (end surface) serving as a bottom (the surface opposite to the surface struck with a male die and may be referred to as the "slug bottom" hereinafter) during impact pressing. In the exemplary embodiment, the slug prepared has the surface serving as the bottom during impact pressing, in which the crystal grain diameter at a depth of 10 μm from the surface is smaller than that at a depth of 30 μm from the surface.

In the surface (slug bottom) serving as the bottom during impact pressing, the crystal grain diameter at a depth of 10 μm from the surface is smaller than that at a depth of 100 μm from the surface, and the crystal grain diameter at a depth of 10 μm from the surface is 30 μm or more and 120 μm or less. From the viewpoint of suppressing the occurrence of recesses in the outer peripheral surface after impact pressing, the crystal grain diameter at a depth of 10 μm from the surface of the slug bottom is preferably 40 μm or more and 100 μm or less and more preferably 40 μm or more and 70 μm or less.

Also, in the surface (slug bottom) of the slug serving as the bottom during impact pressing, from the viewpoint of suppressing the occurrence of recesses in the outer peripheral surface after impact pressing, the crystal grain diameter at a depth of 100 μm from the surface is preferably 50 μm or more and 160 μm or less, more preferably 70 μm or more and 150 μm or less, and still more preferably 70 μm or more and 130 μm or less.

In the exemplary embodiment, the crystal grain diameters at a depth of 10 μm and a depth of 100 μm from the surface of the metal slug are values obtained by observation and measurement with a scanning electron microscope (SEM). Specifically, the crystal grain diameters are measured as follows.

First, the metal slug is cut by using a cutting machine (Secotom-10, manufactured by Struers Inc.) in a direction perpendicular to the surface serving as the bottom during impact pressing. Next, a cutting section is mirror-finished by polishing with a polishing machine (Beta & Vector GRINDER-POPLISHERS AND POWERHEAD, manufactured by Buhler Inc.) to form a sample. Then, the crystal grains in the section are observed with a scanning electron microscope (JSM-7500F, manufactured by JEOL Ltd.), and the crystal grain diameter is calculated.

Figure 6:
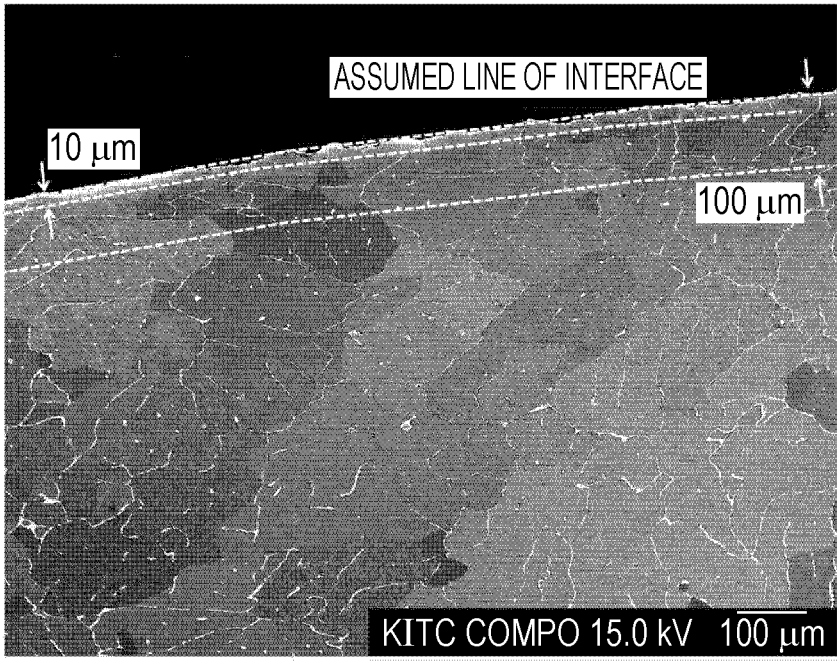
FIG. 6 is a schematic view showing a method for calculating a crystal grain diameter.

In calculating the crystal grain diameter, as shown in FIG. 6, the section in the observed image is photographed, and an assumed line parallel to the surface (interface) is drawn at a position of 10 μm from the interface. The lengths of the crystals crossing the line (measurement length; 1000 μm) is number-averaged to determine the crystal grain diameter.

A method for adjusting the slug bottom so that the crystal grain diameter at a depth of 10 μm from the surface is smaller than that at a depth of 100 μm from the surface, and the crystal grain diameter at a depth of 10 μm from the surface is 30 μm or more and 120 μm or less is not particularly limited. The crystal grain range may be achieved by, for example, a method including shot-peening the bottom of the slug obtained by punching a metal plate or the like as described above. The shot peening is a processing method for imparting work hardening and compressive residual stress due to plastic deformation by projecting and colliding steel-iron or non-ferrous metal particles on a surface to be treated.

In shot peening of the slug bottom, conditions may be determined according to the material of the slug or the like so that the crystal grain diameter at a depth of 10 μm from the surface is 30 μm or more and 120 μm or less, and preferably the crystal grain diameter at a depth of 100 μm from the surface is 50 μm or more and 160 μm or less.

The crystal grain diameter at the slug bottom during shot peening may be controlled by the material, particle diameter, and shape of a projection material, projection pressure, projection time, projection distance (the distance from the projection port of a shot peening apparatus to a plane (surface to be treated) of the slug), etc.

In the exemplary embodiment, examples of the projection material used in shot peening include zircon, glass, stainless, and the like.

The projection material preferably has a spherical shape or a shape close to the spherical shape, and the particle diameter of the projection material is preferably 10 μm or more and 100 μm or less and more preferably 10 μm or more and 50 μm or less from the viewpoint that the crystal grain diameter at a depth of 10 μm from the surface is adjusted to 30 μm or more and 120 μm or less, and preferably the crystal grain diameter at a depth of 100 μm from the surface is adjusted to 50 μm or more and 160 μm or less.

In addition, with increasing projection pressure, increasing projection time, or decreasing projection distance, the crystal grain diameter tends to decrease, and each of the conditions may be selected according to the material of the slug, the intended crystal grain diameter, etc.

The apparatus for shot peening is not particularly limited and, for example, the uniformity of the crystal grain diameter of the surface may be improved by projecting the projection material on the slug bottom while rotating the slug using an apparatus provided with a mechanism which rotates a treatment body to be shot-peened.

The method for adjusting the slug bottom so that the crystal grain diameter at a depth of 10 μm from the surface is smaller than that at a depth of 100 μm from the surface, and the crystal grain diameter at a depth of 10 μm from the surface is 30 μm or more and 120 μm or less may be a method without shot peening. For example, a usable method includes increasing hardness by adding impurities to a material constituting the slug and adjusting the crystal grain diameter at a depth of 10 μm from the surface to 30 μm or more and 120 μm or less.

Impact Pressing

In the impact pressing, a cylinder is formed by impact pressing of the slug with the surface as the bottom.

Figure 1B:
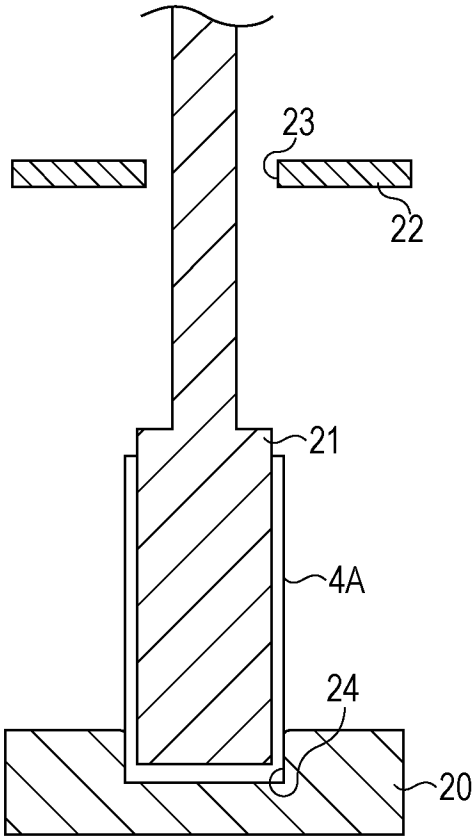
Figure 1C:
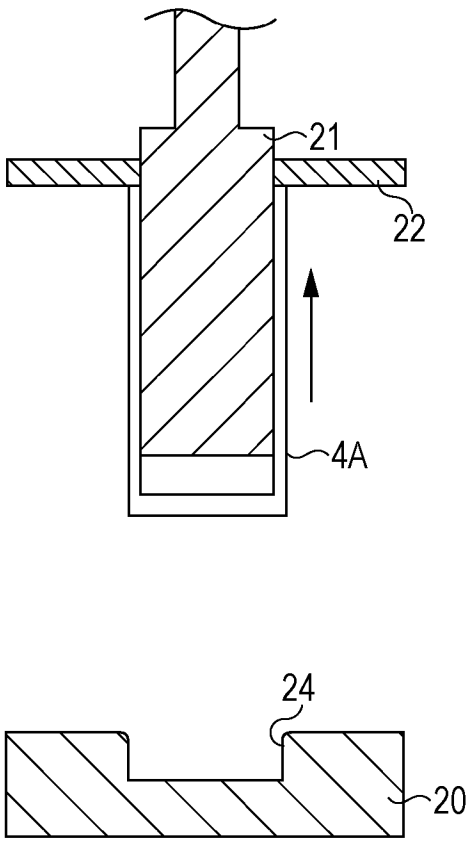

FIGS. 1A to 1C show an example of molding of the cylinder by impact pressing of the slug.

A lubricant is applied to an end surface (slug bottom) of a cylindrical slug 30, and the slug 30 is placed in a circular hole 24 provided in a die (female die) 20 as shown in FIG. 1A. In this case, the slug 30 is placed in the die 20 so that the end surface having a crystal grain diameter of 30 μm or more and 120 μm or less at a depth of 10 μm from the surface is located as the bottom.

Next, as shown in FIG. 1B, the slug 30 placed in the die 20 is pressed by a punch (male die) 21. Consequently, the slug 30 is extended cylindrically from the circular hole of the die 20 so as to cover the periphery of the punch 21. In this case, the bottom of the slug 30 before impact pressing is partially extended to form the outer peripheral surface of a cylinder 4A, and thus the crystal grain diameter of the bottom of the slug 30 is reflected in the surface roughness of the outer peripheral surface of the cylinder 4A.

After molding, as shown in FIG. 1C, the punch 21 is removed by being pulled up and passed through a central hole 23 of a stripper 22, thereby producing the cylindrical compact (cylinder) 4A.

The impact pressing suppresses the occurrence of recessed portions in the outer peripheral surface. In addition, hardness is increased by work hardening, and thus the cylindrical compact (cylinder) 4A having a small thickness and high hardness may be produced.

The thickness of the cylinder 4A is not particularly limited but, for example, when the cylinder 4A is produced as a cylindrical substrate for an electrophotographic photoreceptor, the thickness of the cylinder 4A molded by impact pressing is preferably 0.4 mm or more and 0.8 mm or less and more preferably 0.4 mm or more and 0.6 mm or less from the viewpoint of processing to a thickness of, for example, 0.2 mm or more and 0.9 mm or less by subsequent ironing while maintaining hardness.

Ironing

In the ironing, the inner and outer diameters, cylindricity, circularity, etc. are adjusted by ironing the cylinder molded by impact pressing.

When the cylindrical substrate for an electrophotographic photoreceptor is produced by using the method for producing a metal cylinder according to the exemplary embodiment, the ironing is performed. However, the ironing may be performed according to demand in view of the purpose of the metal cylinder produced.

Figure 2B:
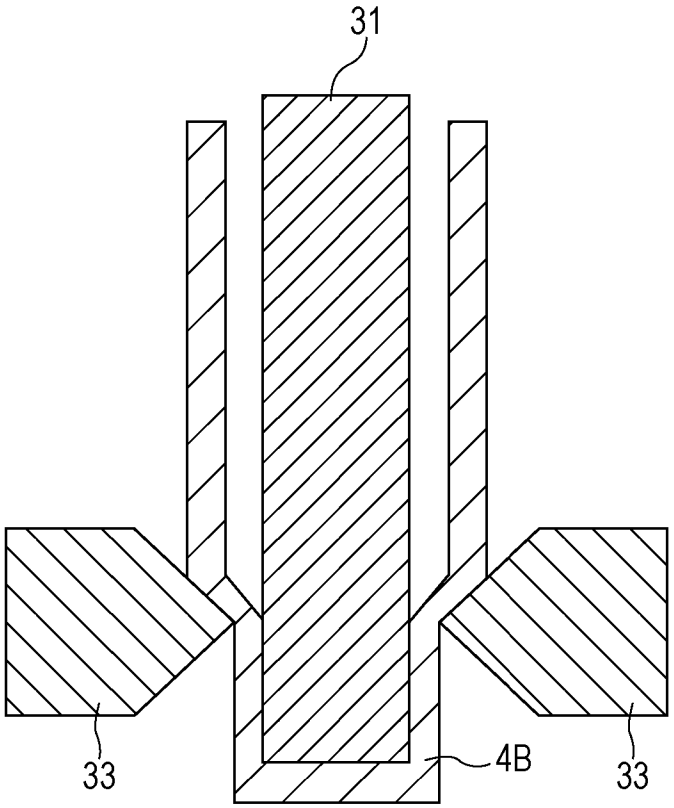
FIGS. 2A and 2B are schematic views showing an example of drawing and fine ironing in a method for producing a metal cylinder according to an exemplary embodiment of the invention.
Figure 2A:
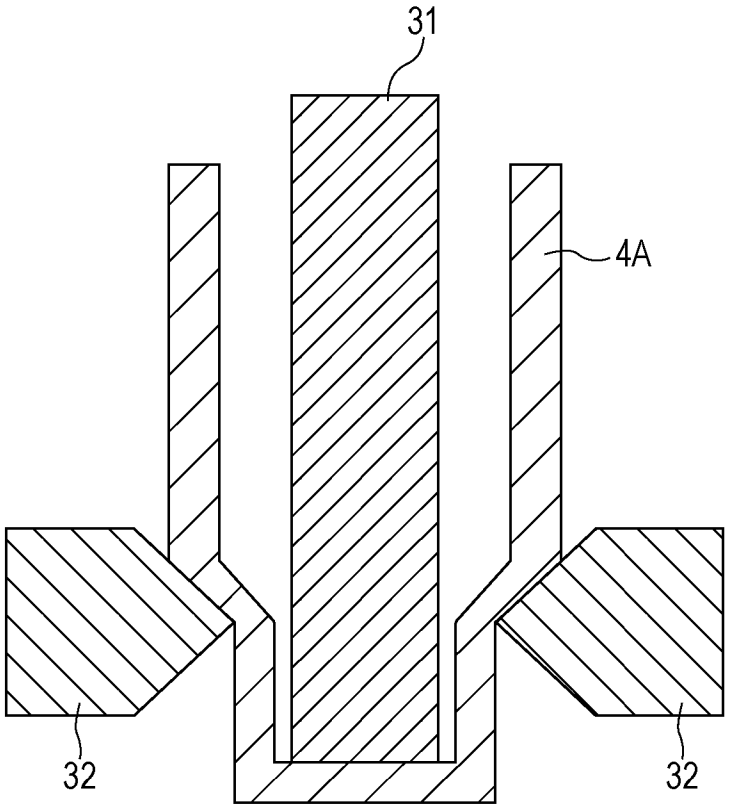

Specifically, as shown in FIG. 2A, if required, the cylinder 4A molded by impact pressing is pushed from the inner side into a die 32 using a cylindrical punch 31 to decrease the diameter by drawing. Then, as shown in FIG. 2B, the cylinder 4A is pushed into a die 33 having a smaller diameter to perform ironing. The ironing may be performed without drawing, or the ironing may be divided in plural steps. The thickness of a cylinder 4B is adjusted by the number of times of ironing.

Also, stress may be released by annealing before ironing.

The thickness of the cylinder 4B after ironing is preferably 0.2 mm or more and 0.9 mm or less and more preferably 0.4 mm or more and 0.6 mm or less from the viewpoint of maintaining the hardness as a substrate for an electrophotographic photoreceptor.

Therefore, when ironing is performed after the cylinder 4A is molded by impact pressing according to the exemplary embodiment, the cylindrical substrate having little recessed portions in the outer peripheral surface, a thin thickness, light weight, and high hardness may be produced.

The method for producing a metal cylinder according to the exemplary embodiment suppresses the occurrence of recessed portions in the outer peripheral surface and thus may produce a cylindrical substrate of quality equivalent to or higher than a substrate produced by a cutting method. Also, in mass production of metal cylinders, an automatic surface test may be eliminated.

When the photoreceptor is used for a laser printer, the oscillation wavelength of a laser is preferably 350 nm or more and 850 nm or less, and the shorter the wavelength is, the more excellent resolution is. The surface of the cylindrical substrate is roughened to a surface roughness Ra of 0.04 μm or more and 0.5 μm or less in order to prevent the occurrence of interference fringes during laser beam irradiation. With a Ra of 0.04 μm or more, an interference preventing effect is obtained, while with a Ra of 0.5 μm or less, the tendency toward rough image quality is effectively suppressed.

In addition, when incoherent light is used as a light source, roughening for preventing interference fringes is not particularly required, and the occurrence of defects due to irregularity in the surface of the cylindrical substrate may be prevented, thereby causing suitability for longer lifetime.

Examples of a roughening method include wet horning treatment of spraying a suspension of an abrasive in water to the cylindrical substrate, center-less grinding treatment of continuously grinding the cylindrical substrate in pressure-contact with a rotating grindstone, anodization treatment, a method of forming a layer containing organic or inorganic semiconductor particles, and the like.

The anodization treatment includes forming an oxide film on an aluminum surface by anodization using aluminum as an anode in an electrolyte solution. Examples of the electrolyte solution include a sulfuric acid solution, an oxalic acid solution, and the like. However, a porous anodized film as it is after the treatment is chemically active and is easily contaminated and has a large variation in resistance with environment. Therefore, sealing treatment is performed by treating the anodized film with steam under pressure or boiling water (to which a metal salt of nickel or the like may be added) to seal micro-pores by hydration reaction volume expansion and to convert the oxide to more stable hydrous oxide.

The thickness of the anodized film is preferably 0.3 μm or more and 15 μm or less. With the thickness within the range, there is the tendency to exhibit a barrier property against injection, and also there is the tendency to suppress an increase in remaining potential by repeated use.

The outer peripheral surface of the cylindrical substrate may be treated with an acid treatment solution or boehmite.

The treatment with an acid treatment solution is performed by using an acid treatment solution containing phosphoric acid, chromic acid, and hydrofluoric acid as described below. With respect to the ratios of phosphoric acid, chromic acid, and hydrofluoric acid mixed in the acid treatment solution, the ratio of phosphoric acid is within a range of 10% by weight or more and 11% by weight or less, the ratio of chromic acid is within a range of 3% by weight or more and 5% by weight or less, the ratio of hydrofluoric acid is within a range of 0.5% by weight or more and 2% by weight or less, and the total concentration of the acids is preferably 13.5% by weight or more and 18% by weight or less. The treatment temperature is 42° C. or more and 48° C. or less, but a thick film may be more rapidly formed by maintaining the treatment temperature high. The thickness of the film is preferably 0.3 μm or more and 15 μm or less.

The boehmite treatment is performed by immersing the cylindrical substrate in pure water at 90° C. or more 100° C. or less for 5 minutes or more and 60 minutes or less or by bringing the cylindrical substrate in contact with heated steam at 90° C. or more 120° C. or less for 5 minutes or more and 60 minutes or less. The thickness of the film is preferably 0.1 μm or more and 5 μm or less. The film may further anodized by using an electrolyte solution with low film solubility, such as a solution of adipic acid, boric acid, borate, phosphate, phthalate, maleate, benzoate, tartrate, citrate, or the like.

Method for Manufacturing Electrophotographic Photoreceptor

A method for manufacturing an electrophotographic photoreceptor according to an exemplary embodiment includes preparing, as a substrate for an electrophotographic photoreceptor, a metal cylinder produced by the method for producing a metal cylinder according to the exemplary embodiment, and forming a photosensitive layer on the outer peripheral surface of the metal cylinder.

Figure 3:
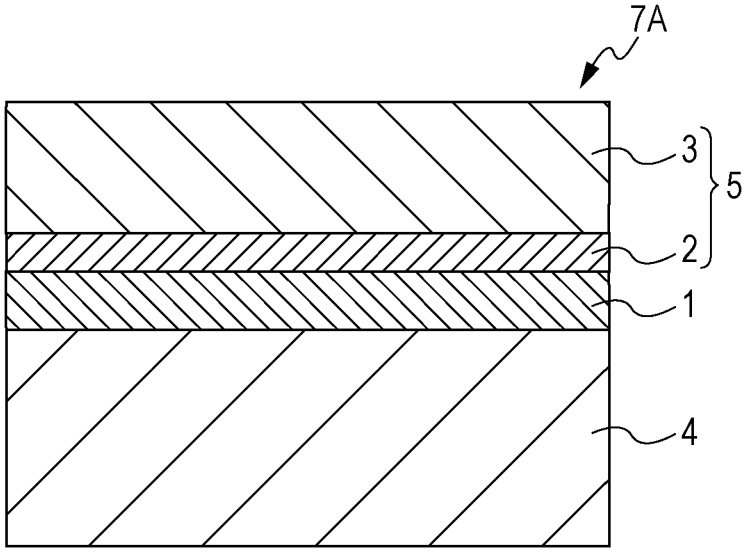
FIG. 3 is a schematic partial sectional view showing an example of a configuration of an electrophotographic photoreceptor manufactured by a method for manufacturing an electrophotographic photoreceptor according to an exemplary embodiment of the invention.

FIG. 3 is a schematic partial sectional view showing an example of a layer configuration of an electrophotographic photoreceptor produced by the method for manufacturing an electrophotographic photoreceptor according to the exemplary embodiment. An electrophotographic photoreceptor 7A shown in FIG. 3 has a structure in which an undercoat layer 1, a charge generation layer 2, and a charge transport layer 3 are laminated in that order on a cylindrical substrate 4, and the charge generation layer 2 and the charge transport layer 3 constitute a photosensitive layer 5.

The electrophotographic photoreceptor is not limited to the layer configuration shown in FIG. 3, and for example, a protecting layer may be further formed as an outermost layer on the photosensitive layer. In addition, the undercoat layer 1 need not be necessarily provided, and a single-layer photosensitive layer in which the functions of the charge generation layer 2 and the charge transport layer 3 are integrated may be provided.

Image Forming Apparatus (and Process Cartridge)

An image forming apparatus according to an exemplary embodiment includes an electrophotographic photoreceptor, a charging unit that charges the surface of the electrophotographic photoreceptor, an electrostatic latent image forming unit that forms an electrostatic latent image on the surface of the charged electrophotographic photoreceptor, a development unit that develops, with a developer containing a toner, the electrostatic latent image formed on the surface of the electrophotographic photoreceptor to form a toner image, and a transfer unit that transfers the toner image to a surface of a recording medium. An electrophotographic photoreceptor manufactured by the method for manufacturing an electrophotographic photoreceptor according to the exemplary embodiment is used as the electrophotographic photoreceptor.

Examples of an image forming apparatus applied to the image forming apparatus according to the exemplary embodiment include known image forming apparatuses such as an apparatus provided with a fixing unit that fixes a toner image transferred to a surface of a recording medium; a direct-transfer type apparatus in which a toner image formed on the surface of an electrophotographic photoreceptor is directly transferred to a recording medium; an intermediate transfer type apparatus in which a toner image formed on the surface of an electrophotographic photoreceptor is first transferred to a surface of an intermediate transfer body and then the toner image transferred to the surface of the intermediate transfer body is second transferred to a surface of a recording medium; an apparatus provided with a cleaning unit that cleans the surface of an electrophotographic photoreceptor before charging after transfer of a toner image; an apparatus provided with a static eliminating unit that eliminates electricity in the surface of an electrophotographic photoreceptor by irradiation with static eliminating light before charging after transfer of a toner image; an apparatus provided with an electrophotographic photoreceptor heating member that increases the temperature of the electrophotographic photoreceptor to decrease the relative temperature; and the like.

In the case of the intermediate transfer-type apparatus, an example of a configuration applied to the transfer unit includes an intermediate transfer body in which a toner image is transferred to a surface, a first transfer unit in which the toner image formed on the surface of the electrophotographic photoreceptor is first transferred to the surface of the intermediate transfer body, and a second transfer unit in which the toner image formed on the surface of the intermediate transfer body is second transferred to a surface of the recording medium.

In the image forming apparatus according to the exemplary embodiment, for example, a portion provided with the electrophotographic photoreceptor may have a cartridge structure (process cartridge) detachable from the image forming apparatus. For example, a process cartridge used as the process cartridge is one provided with the electrophotographic photoreceptor according to the exemplary embodiment. Besides the electrophotographic photoreceptor, the process cartridge may be provided with at least one selected from the group consisting of a charging unit, an electrostatic latent image forming unit, a development unit, and a transfer unit.

An example of the image forming apparatus according to the exemplary embodiment is described below, but the apparatus is not limited to this example. In addition, the portions shown in the drawings are described, and description of the other portions is omitted.

Figure 4:
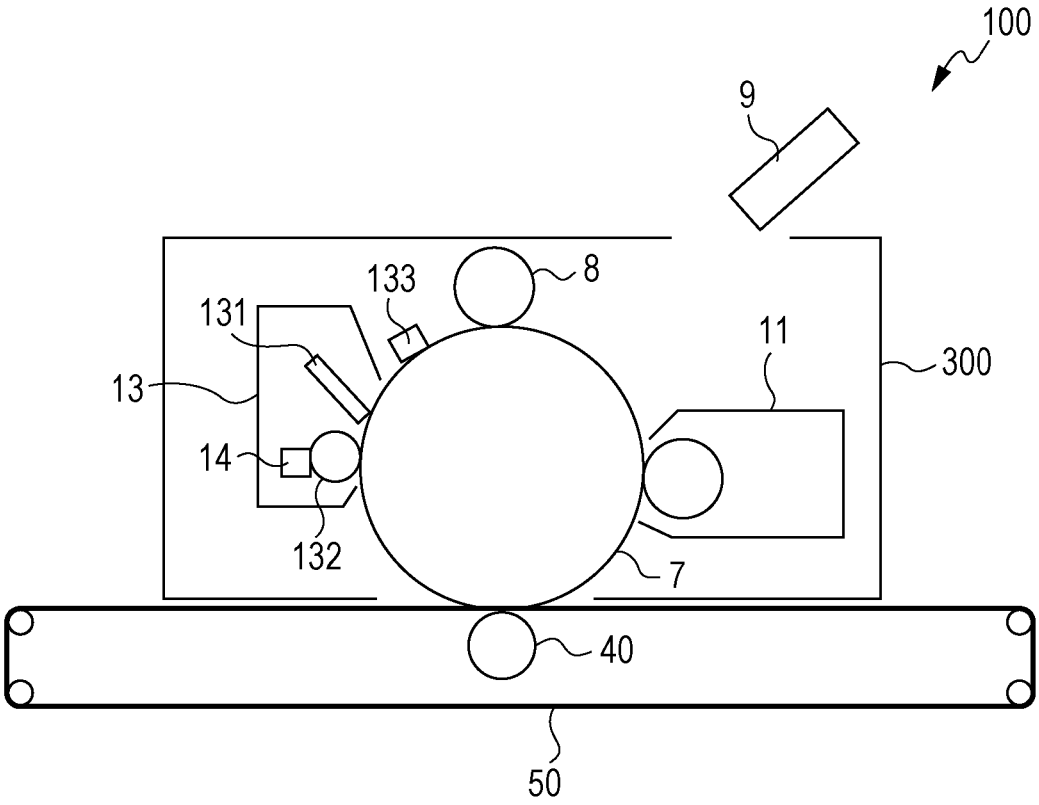
FIG. 4 is a schematic configuration diagram showing an example of an image forming apparatus according to an exemplary embodiment of the invention.

FIG. 4 is a schematic configuration diagram showing an example of the image forming apparatus according to the exemplary embodiment.

As shown in FIG. 4, an image forming apparatus 100 according to the exemplary embodiment includes a process cartridge 300 provided with an electrophotographic photoreceptor 7, an exposure device 9 (an example of the electrostatic latent image forming unit), a transfer device 40 (first transfer device), and an intermediate transfer body 50. In the image forming apparatus 100, the exposure device 9 is disposed at a position where the electrophotographic photoreceptor 7 may be exposed from an opening of the process cartridge 300. The transfer device 40 is disposed at a position facing the electrophotographic photoreceptor 7 through the intermediate transfer body 50, and the intermediate transfer body 50 is disposed so as to be in partial contact with the electrophotographic photoreceptor 7. Although not shown in the drawing, the image forming apparatus 100 also includes a second transfer device that transfers the toner image transferred to the intermediate transfer body 50 to the recording medium (for example, paper). The intermediate transfer body 50, the transfer device 40 (first transfer device), and the second transfer device (not shown) correspond to an example of the transfer unit.

The process cartridge 300 shown in FIG. 4 includes a housing in which the electrophotographic photoreceptor 7, the charging device 8 (an example of the charging unit), the development device 11 (an example of the development unit), and a cleaning device 13 (an example of the cleaning unit) are integrally supported. The cleaning device 13 has a cleaning blade (an example of a cleaning member) 131 which is disposed in contact with the surface of the electrophotographic photoreceptor 7. The cleaning member may be a conductive or insulating fibrous member, not the form of the cleaning blade 131, and the cleaning member may be used singly or used in combination with the cleaning blade 131.

FIG. 4 shows an example of the image forming apparatus in which a fibrous member 132 (roll-shaped) that supplies a lubricant 14 to the surface of the electrophotographic photoreceptor 7, and a fibrous member 133 (flat-brush-shaped) that assists cleaning are provided. However, these members are disposed according to demand.

Figure 5:
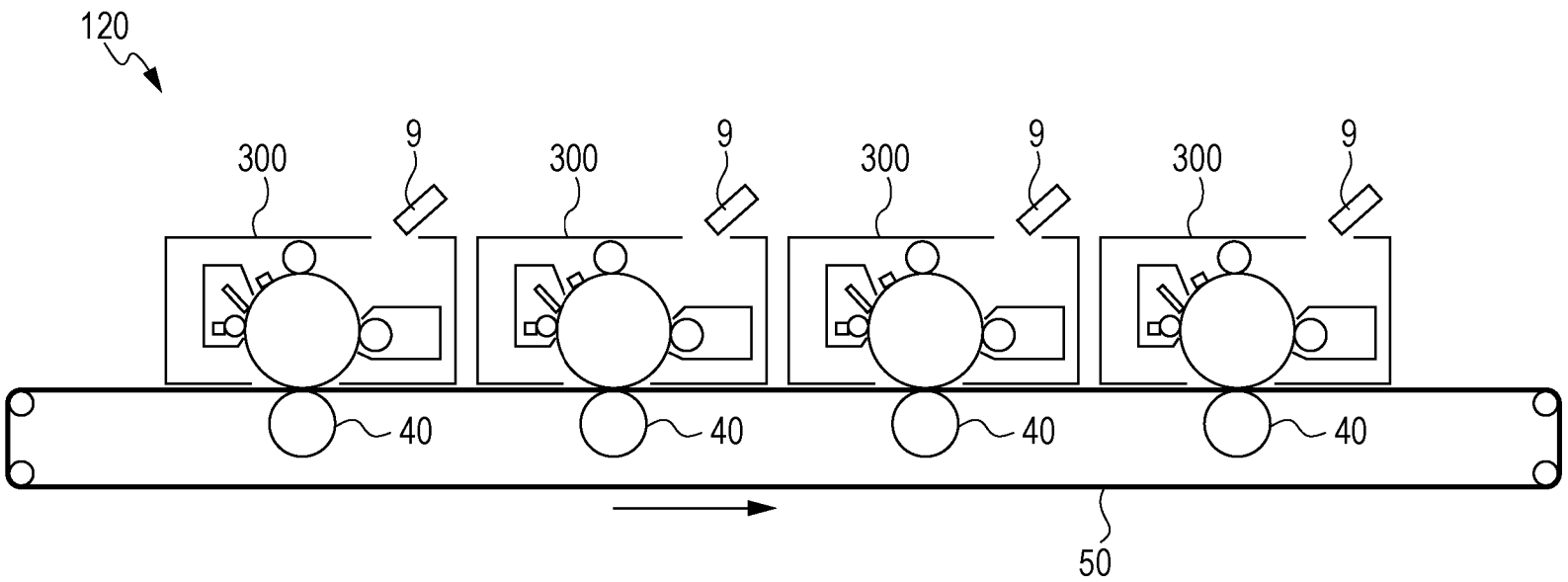
FIG. 5 is a schematic configuration diagram showing another example of an image forming apparatus according to an exemplary embodiment of the invention.

FIG. 5 is a schematic configuration diagram showing another example of the image forming apparatus according to the exemplary embodiment.

An image forming apparatus 120 shown in FIG. 5 is a tandem-system multicolor image forming apparatus provided with four process cartridges 300. The image forming apparatus 120 is configured so that the four process cartridges 300 are arranged in parallel on an intermediate transfer body 50, and an electrophotographic photoreceptor is used for one color. The image forming apparatus 120 has the same configuration as the image forming apparatus 100 except being of a tandem system.

In the description of the embodiments, description is mainly made of a case in which the cylindrical substrate for an electrophotographic photoreceptor is produced by the method for producing a metal cylinder according to the exemplary embodiment, but the method for producing a metal cylinder according to the exemplary embodiment is not limited to the method for producing a cylindrical substrate for an electrophotographic photoreceptor. The method for producing a metal cylinder according to the exemplary embodiment may be applied to, for example, production of a cylindrical substrate such as a charging roller, a transfer roller, or the like in an image forming apparatus, and production of a cylinder of an apparatus other than an image forming apparatus, such as a capacitor case, a battery case, a marker pen, or the like.

EXAMPLES

Examples of the present invention are described below, but the present invention is not limited to these examples below.

Formation of Cylindrical Tube

Comparative Example 1

An aluminum cylindrical slug having a diameter of 34 mm and a thickness of 15 mm is prepared by punching an aluminum plate (A1070) having a thickness of 15 mm. As a result of measurement of the crystal grain diameters at a depth of 10 μm and at a depth of 100 μm from the slug surface by a known method, the crystal grain diameter at a depth of 10 μm from the surface is 134. 2 μm, and the crystal grain diameter at a depth of 100 μm from the surface is 148.3 μm.

Then, a lubricant is applied to the surface of the slug, and the slug is molded in a cylindrical shape having a diameter 34 mm by impact pressing.

Next, an aluminum cylindrical tube having a diameter of 30 mm, a length of 251 mm, and a wall thickness of 0.5 mm is formed by one time of ironing.

Then, a recessed portion distribution on the outer peripheral surface of the resultant cylindrical tube is formed by using an automatic surface tester, and the number of recessed portions (a diameter of 30 μm or more) is measured.

Further, the positions of recessed portions in the outer peripheral surface of the cylindrical tube are specified based on the recessed portion distribution, and the sizes (diameter) of the recessed portions are measured by a laser microscope. As a result, the maximum size of the recessed portions is about 300 μm.

Example 1

An aluminum cylindrical slug having a diameter of 34 mm and a thickness of 15 mm is prepared by punching an aluminum plate (A1070) having a thickness of 15 mm.

The slug is shot-peened by using a shot peening apparatus (manufactured by Fuji Manufacturing Co., Ltd.) under conditions below.

Projection material: manufactured by Fuji Manufacturing Co., Ltd., zircon #400 (center particle diameter 45 μm)

Projection pressure: 0.25 MPa

Projection time: 10 seconds

Shot distance: 150 mm

Number of slug rotations: 40 rpm

As a result of measurement of the crystal grain diameters at a depth of 10 μm and at a depth of 100 μm from the slug surface serving as the bottom in impact pressing by a known method, the crystal grain diameter at a depth of 10 μm from the surface is 44.7 μm, and the crystal grain diameter at a depth of 100 μm from the surface is 74.2 μm.

Then, a lubricant is applied to the shot-peened slug, and the slug is molded in a cylindrical shape having a diameter 34 mm by impact pressing.

Next, an aluminum cylindrical tube having a diameter of 30 mm, a length of 251 mm, and a wall thickness of 0.5 mm is formed by one time of ironing.

Then, the number and sizes of recessed portions (a diameter of 30 μm or more) in the outer peripheral surface of the resultant cylindrical tube are measured by the same method as in Comparative Example 1. As a result, the number of recessed portions is decreased by about 80% as compared with the cylindrical tube produced in Comparative Example 1, and the maximum size of the recessed portions is about 140 μm.

Example 2

A slug is prepared by the same method as in Example 1 and then surface-treated by the same method as in Example 1 except that the projection pressure of shot peening is changed to 0.15 MPa. As a result of measurement of the crystal grain diameters at a depth of 10 μm and at a depth of 100 μm from the slug surface serving as the bottom in impact pressing by a known method, values shown in Table 1 below are obtained.

Then, a lubricant is applied to the shot-peened slug, and the slug is molded in a cylindrical shape having a diameter 34 mm by impact pressing.

Next, an aluminum cylindrical tube having a diameter of 30 mm, a length of 251 mm, and a wall thickness of 0.5 mm is formed by one time of ironing.

Then, the number and sizes of recessed portions (a dimeter of 30 μm or more) in the outer peripheral surface of the resultant cylindrical tube are measured by the same method as in Comparative Example 1. As a result, the number of recessed portions is decreased by about 70% as compared with the cylindrical tube produced in Comparative Example 1, and the maximum size of the recessed portions is about 150 μm.

Example 3

A slug is prepared by the same method as in Example 1 and then surface-treated by the same method as in Example 1 except that the projection pressure of shot peening is changed to 0.08 MPa. As a result of measurement of the crystal grain diameters at a depth of 10 μm and at a depth of 100 μm from the slug surface serving as the bottom in impact pressing by a known method, values shown in Table 1 below are obtained.

Then, a lubricant is applied to the shot-peened slug, and the slug is molded in a cylindrical shape having a diameter 34 mm by impact pressing.

Next, an aluminum cylindrical tube having a diameter of 30 mm, a length of 251 mm, and a wall thickness of 0.5 mm is formed by one time of ironing.

Then, the number and sizes of recessed portions (a dimeter of 30 μm or more) in the outer peripheral surface of the resultant cylindrical tube are measured by the same method as in Comparative Example 1. As a result, the number of recessed portions is decreased by about 60% as compared with the cylindrical tube produced in Comparative Example 1, and the maximum size of the recessed portions is about 180 μm.

Example 4

An aluminum cylindrical slug having a diameter of 34 mm and a thickness of 15 mm is prepared by punching an aluminum plate (A3003) having a thickness of 15 mm. As a result of measurement of the crystal grain diameters at a depth of 10 μm and at a depth of 100 μm from the slug surface serving as the bottom in impact pressing by a known method, values shown in Table 1 below are obtained.

Then, a lubricant is applied to the slug, and the slug is molded in a cylindrical shape having a diameter 34 mm by impact pressing.

Next, an aluminum cylindrical tube having a diameter of 30 mm, a length of 251 mm, and a wall thickness of 0.5 mm is formed by one time of ironing.

Then, the number and sizes of recessed portions (a dimeter of 30 μm or more) in the outer peripheral surface of the resultant cylindrical tube are measured by the same method as in Comparative Example 1. As a result, the number of recessed portions is decreased by about 40% as compared with the cylindrical tube produced in Comparative Example 1, and the maximum size of the recessed portions is about 180 μm.

Comparative Example 2

A slug is prepared by the same method as in Example 1 and then surface-treated by the same method as in Example 1 except that the projection pressure of shot peening is changed to 0.05 MPa. As a result of measurement of the crystal grain diameters at a depth of 10 μm and at a depth of 100 μm from the slug surface serving as the bottom in impact pressing by a known method, values shown in Table 1 below are obtained.

Then, a lubricant is applied to the shot-peened slug, and the slug is molded in a cylindrical shape having a diameter 34 mm by impact pressing.

Next, an aluminum cylindrical tube having a diameter of 30 mm, a length of 251 mm, and a wall thickness of 0.5 mm is formed by one time of ironing.

Then, the number and sizes of recessed portions (a dimeter of 30 μm or more) in the outer peripheral surface of the resultant cylindrical tube are measured by the same method as in Comparative Example 1. As a result, the number of recessed portions is decreased by about 50% as compared with the cylindrical tube produced in Comparative Example 1, and the maximum size of the recessed portions is about 250 μm.

Comparative Example 3

A slug is prepared by the same method as in Example 1 and then surface-treated by the same method as in Example 1 except that the projection pressure of shot peening is changed to 0.5 MPa. As a result of measurement of the crystal grain diameters at a depth of 10 μm and at a depth of 100 μm from the slug surface serving as the bottom in impact pressing by a known method, values shown in Table 1 below are obtained.

Then, a lubricant is applied to the shot-peened slug, but the slug cannot be molded in a cylindrical shape by impact pressing. The conceivable reason for this is that the slug hardness is excessively increased by shot peening.

Evaluation of Cylindrical Tube

A recessed portion distribution on the outer peripheral surface of each of the resultant cylindrical tubes is formed by using an automatic surface tester, and the number of recessed portions (a dimeter of 30 μm or more) is measured. Further, the positions of recessed portions in the outer peripheral surface of the cylindrical tube are specified based on the recessed portion distribution, and the sizes (diameter) of the recessed portions are measured by a laser microscope and evaluated based on criteria below.

The slug of Comparative Example 3 cannot be molded into a cylinder, and thus a cylindrical tube cannot be evaluated.

Therefore, overall evaluation is "D" regardless of the criterial below.

The evaluation results are shown in Table 1. (Reduction rate of recessed portion)

A: A reduction rate of 50% or more as compared with Comparative Example 1

B: A reduction rate of 25% or more and less than 50% as compared with Comparative Example 1

C: A reduction rate of less than 25% as compared with Comparative Example 1

Maximum Size of Recessed Portion

A: 150 μm or less

B: Over 150 μm and 200 μm or less

C: Over 200 μm

Overall Determination

A: Determination as "A" in evaluation of both the reduction rate of recessed portions and the maximum size of recessed portions B: Determination as "A" in evaluation of one of the reduction rate of recessed portions and the maximum size of recessed portions and determination as "B" in evaluation of the other C: Determination as "B" in evaluation of both the reduction rate of recessed portions and the maximum size of recessed portions D: Determination as "D" in evaluation of at least one of the reduction rate of recessed portions and the maximum size of recessed portions

TABLE 1

| | Shot peening | | Crystal grain dimeter (μm) | | Evaluation of recess | | | | |
|---|---|---|---|---|---|---|---|---|---|
| | Projection pressure (MPa) | Treatment time (sec) | Depth from surface 10 μm | Depth from surface 100 μm | Maximum size of recess [μm] | Determination | Reduction rate of recess [%] | Determination | Overall determination |
| Example 1 | 0.25 | 10 | 44.7 | 74.2 | 140 | A | 80 | A | A |
| Example 2 | 0.15 | 10 | 67.1 | 122.5 | 150 | A | 70 | A | A |
| Example 3 | 0.08 | 10 | 92.2 | 148.3 | 180 | B | 60 | A | B |
| Example 4 | Untreated (hardness increase by impurity) | | 109.5 | 134.2 | 180 | B | 40 | B | C |
| Comparative Example 1 | Untreated | | 134.2 | 148.3 | 300 | C | — | C | D |
| Comparative Example 2 | 0.05 | 10 | 130.4 | 154.9 | 250 | C | 50 | A | D |
| Comparative Example 3 | 0.5 | 10 | 26.5 | 154.9 | Impossible to form into cylindrical tube | | | | D |

Production of Electrophotographic Photoreceptor

Formation of Substrate for Electrophotographic Photoreceptor

The aluminum cylindrical tubes produced in Examples 1, 2, 3, and 4 and Comparative Examples 1 and 2 are used as conductive supports (substrates for an electrophotographic photoreceptor) E1, E, E3, E4, C1, and C2, respectively.

Formation of Undercoat Layer

First, 100 parts by weight of zinc oxide (average particle diameter: 70 nm, manufactured by Tayca Corporation, specific surface area value 15 $m^2/g$) is mixed with 500 parts by weight of tetrahydrofuran by stirring, and 1.3 parts by weight of a silane coupling agent (KBM503, manufactured by Shin-Etsu Chemical Co., Ltd.) is added to the resultant mixture and stirred for 2 hours. Then, tetrahydrofuran is distilled off by distillation under reduced pressure, and the residue is baked at 120° C. for 3 hours to produce zinc oxide surface-treated with the silane coupling agent.

Then, 110 parts by weight of the surface-treated zinc oxide and 500 parts by weight of tetrahydrofuran are mixed by stirring, and a solution prepared by dissolving 0.6 parts by weight of alizarin in 50 parts by weight of tetrahydrofuran is added to the resultant mixture and stirred at 50° C. for 5 hours. Then, alizarin-added zinc oxide is filtered off by reduced-pressure filtration and then dried at 60° C. under reduced pressure to produce alizarin-added zinc oxide.

Then, 60 parts by weight of the alizarin-added zinc oxide, 13.5 parts by weight of a curing agent (blocked isocyanate Sumidur 3175, manufactured by Sumitomo Bayer Urethane Co., Ltd.), 15 parts by weight of butyral resin (S-LEC BM-1, manufactured by Sekisui Chemical Co., Ltd.), and 85 parts by weight of methyl ethyl ketone are mixed to prepare a mixed solution. Then, 38 parts by weight of the mixed solution and 25 parts by weight of methyl ethyl ketone are mixed and dispersed for 2 hours with a sand mill using glass beads of 1 mmφ to produce a dispersion.

To the resultant dispersion, 0.005 parts by weight of dioctyltin dilaurate and 45 parts by weight of silicone resin particles (Tospearl 145, manufactured by Momentive Performance Materials Inc.) are added, thereby producing a coating solution for forming an undercoat layer.

The resultant coating solution for forming an undercoat layer is applied, by a dip coating method, to the outer peripheral surface of each of the cylindrical tubes E1, E2, E3, E4, C1, and C2 produced as conductive supports in the examples and comparative examples, and dried and cured at 170° C. for 30 minutes to form an undercoat layer having a thickness of about 23 μm.

Formation of Charge Generation Layer

Next, 1 part by weight of hydroxygallium phthalocyanine having strong diffraction peaks at Bragg angles (2θ±0.2°) of 7.5°, 9.9°, 12.5°, 16.3°, 18.6°, 25.1°, and 28.3° in an X-ray diffraction spectrum is mixed with 1 part by weight of polyvinyl butyral (S-LEC BM-S, manufactured by Sekisui Chemical Co., Ltd.) and 80 parts by weight of n-butyl acetate, and the resultant mixture is dispersed together with glass beads in a paint shaker for 1 hour to prepare a coating solution for forming a charge generation layer. The resultant coating solution is applied, by a dip coating method, to the conductive support on which the undercoat layer has been formed, and dried by heating at 100° C. for 10 minutes to form a charge generation layer having a thickness of about 0.15 μm.

Formation of Charge Transport Layer

Next, 2.6 parts by weight of benzidine represented by formula (CT-1) below and 3 parts by weight of a polymer compound having a repeat unit represented by formula (B-1) below (viscosity-average molecular weight: 40,000) are dissolved in 25 parts by weight of tetrahydrofuran to prepare a coating solution for forming a charge transport layer. The resultant coating solution is applied, by a dip coating method, to the charge generation layer and heated at 130° C. for 45 minutes to form a charge transport layer having a thickness of 20 μm. Consequently, each of electrophotographic photoreceptors E1, E2, E3, E4, C1, is C2 are produced.

(CT-1)

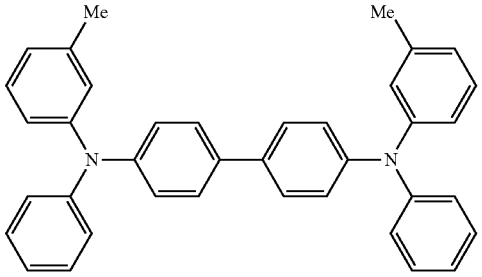

(B-1)

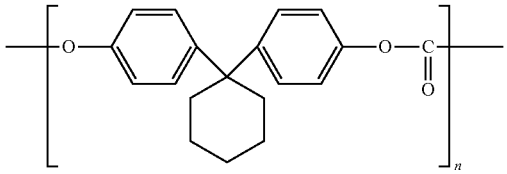

Evaluation and Results

Each of the produced electrophotographic photoreceptors E1, E2, E3, E4, C1, and C2 is loaded on a process cartridge of DocuPrint P450 manufactured by Fuji Xerox Co., Ltd., and a solid image (100% density) is output on A4 paper (manufactured by Fuji Xerox Co., Ltd., C2 paper) in an environment at 22° C. and 50% RH. The occurrence of white dots is evaluated in an image on the 5th paper based on criteria below.

The evaluation results are shown in Table 2.

Evaluation of White Dots i) With respect to white dots of 0.7 mm or more
- A: No occurrence
- C: Occurrence of one or more ii) With respect to white dots of 0.5 mm or more and less than 0.7 mm
- A: No occurrence
- B: Occurrence of one
- C: Occurrence of two or more iii) With respect to white dots of 0.3 mm or more and less than 0.5 mm
- A: No occurrence
- B: Occurrence of one or more and five or less
- C: Occurrence of six or more Overall Determination A: Determination as "A" in the three items in evaluation of white dots B: Determination as "A" in two items and "B" in one item in evaluation of white dots C: Determination as "A" in one item and "B" in two items in evaluation of white dots D: Determination as "A" in at least one of the items in evaluation of white dots

TABLE 2

| Substrate for electrophotographic photoreceptor | Number of white dots occurring | | | | | | |
|---|---|---|---|---|---|---|---|
| | 0.7 mm or more | Determination | 0.5 mm or more and less than 0.7 mm | Determination | 0.3 mm or more and less than 0.5 mm | Determination | Overall determination |
| E1 | 0 | A | 0 | A | 0 | A | A |
| E2 | 0 | A | 0 | A | 0 | A | A |
| E3 | 0 | A | 0 | A | 1 | B | B |
| E4 | 0 | A | 1 | B | 3 | B | C |
| C1 | 3 | C | 8 | C | 15 | C | D |
| C2 | 1 | C | 3 | C | 7 | C | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A metal slug comprising:

a surface, wherein the metal slug is configured for impact pressing, wherein the surface is adjusted so that a crystal grain diameter in a direction parallel to the surface at a depth of 10 pm from the surface is smaller than a crystal grain diameter in the direction parallel to the surface at a depth of 100 pm from the surface, and the crystal grain diameter at the depth of 10 pm from the surface is 30 pm or more and 120 pm or less, wherein the metal slug comprises aluminum, wherein the metal slug is cylindrical, and wherein the metal slug has a diameter of 34 mm and a thickness of 15 mm.

2. The metal slug according to claim 1, wherein the crystal grain diameter at the depth of 100 μm from the surface is 50 μm or more and 160 μm or less.

3. The metal slug according to claim 1, wherein a maximum size of recessed portions in the surface is about 140 μm.

4. The metal slug according to claim 1, wherein a maximum size of recessed portions in the surface is about 150 μm.

5. The metal slug according to claim 1, wherein a maximum size of recessed portions in the surface is about 180 μm.

* * * * *